US007552572B2

(12) United States Patent
Bois

(10) Patent No.: US 7,552,572 B2
(45) Date of Patent: Jun. 30, 2009

(54) ADVANCED PACKAGING METHOD AND DEVICE, BAGS OBTAINED AND USE THEREOF

(75) Inventor: Henri Bois, Neuilly sur Seine (FR)

(73) Assignee: S2F Flexico, Henonville (FR)

( * ) Notice: Subject to any disclaimer, the term of this patent is extended or adjusted under 35 U.S.C. 154(b) by 0 days.

(21) Appl. No.: 10/541,648

(22) PCT Filed: May 14, 2004

(86) PCT No.: PCT/FR2004/001185

§ 371 (c)(1),
(2), (4) Date: Jun. 19, 2006

(87) PCT Pub. No.: WO2004/103843

PCT Pub. Date: Dec. 2, 2004

(65) Prior Publication Data

US 2007/0157560 A1 Jul. 12, 2007

(30) Foreign Application Priority Data

May 16, 2003 (FR) ..... 03 05887

(51) Int. Cl.
*B65B 61/18* (2006.01)

(52) U.S. Cl. ..... 53/412; 53/133.4; 53/139.2; 383/61.2; 383/64; 383/203; 493/213; 493/927

(58) Field of Classification Search ..... 53/412, 53/133.4, 139.2; 493/213, 927; 383/203, 383/61.2, 64
See application file for complete search history.

(56) References Cited

U.S. PATENT DOCUMENTS 4,191,230 A * 3/1980 Ausnit ..... 383/61.2
5,002,781 A * 3/1991 Van Erden ..... 426/106
5,036,645 A * 8/1991 Schwarz ..... 53/412
5,063,069 A * 11/1991 Van Erden et al. ..... 426/122
5,107,658 A * 4/1992 Hustad et al. ..... 53/408
5,129,734 A * 7/1992 Van Erden ..... 383/61.2
5,875,611 A * 3/1999 Plourde ..... 53/412

(Continued)

FOREIGN PATENT DOCUMENTS

EP 1226929 A1 * 7/2002

(Continued)

*Primary Examiner*—Stephen F Gerrity
(74) *Attorney, Agent, or Firm*—Blakely, Sokoloff, Taylor & Zafman LLP

(57) ABSTRACT

A packaging method includes the providing of a bag. A mouth of the bag may include an opening/closing for multiple successive openings and closings and a cleavable linking veil, located at a distance therefrom inside the bag in relation to the opening/closing. The method may also include introduction of contents to be wrapped in the bag and tightening of said bag in order to close it, with tension being applied to the contents. A veil may enter into contact with the contents to avoid the application of stress on the opening/closing, and guarantee free access to the contents via said opening/closing after tearing the cleavable linking veil. In one embodiment, free access to bag contents enables the bag to be relaxed in a closed state as a result of the distance (D) separating the veil and the opening/closing. The invention also relates to a packaging device and to bags thus obtained.

14 Claims, 1 Drawing Sheet

U.S. PATENT DOCUMENTS

Figure 1:
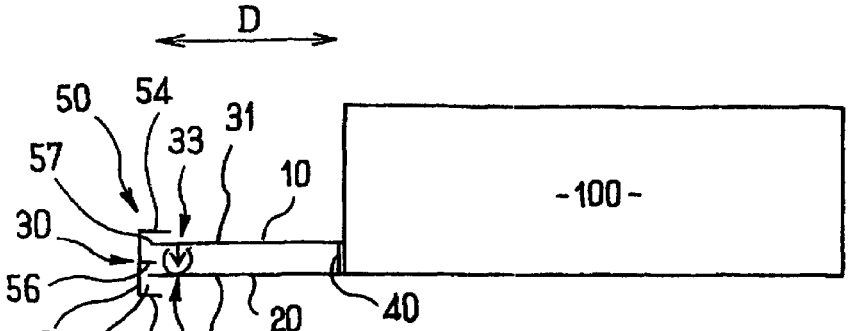

| | | | | |
|---|---|---|---|---|
| 6,257,763 | B1 | 7/2001 | Stolmeier et al. | |
| 6,308,498 | B1 * | 10/2001 | Malin et al. | 53/412 |
| 6,427,421 | B1 | 8/2002 | Belmont et al. | |
| 6,477,821 | B1 | 11/2002 | Bois | |
| 6,517,242 | B1 | 2/2003 | Buchman | |
| 6,918,230 | B2 * | 7/2005 | Thieman | 53/412 |
| 2001/0053253 | A1 | 12/2001 | Buchman et al. | |
| 2002/0150313 | A1 * | 10/2002 | Bois | 383/63 |
| 2002/0162767 | A1 | 11/2002 | Ohtsubo | |
| 2004/0114838 | A1 * | 6/2004 | McGregor | 383/204 |

FOREIGN PATENT DOCUMENTS

| | | | |
|---|---|---|---|
| FR | 2546481 | A1 * | 11/1984 |
| FR | 2824806 | | 11/2002 |

* cited by examiner

ADVANCED PACKAGING METHOD AND DEVICE, BAGS OBTAINED AND USE THEREOF

The present patent application is a non-provisional application of International Application No. PCT/FR2004/001185, filed May 14, 2004.

FIELD

The present invention relates to the field of packaging bags.

More specifically, the present invention relates to the field of packaging bags comprising opening/closing means for multiple successive openings and closings, for example and non-limitatively as complementary profiles.

SUMMARY

The object of the present invention is to improve the known bags.

This object is achieved within the scope of the present invention, by a packaging method which comprises the steps:

provision of a bag whose mouth includes opening/closing means for multiple successive openings and closings on the one hand, and on the other hand, a cleavable linking veil located at a certain distance therefrom, inside the bag, in relation to said opening/closing means, introduction of contents to be wrapped in the bag, and tightening of the bag in order to close it, tension being applied to said contents, said veil entering into contact with the contents avoiding the application of stresses on the opening/closing means, guaranteeing free access to the contents via said opening/closing means after tearing, enabling the bag to be relaxed in a closed state as a result of the distance separating the veil and the opening/closing means.

The present invention also relates to a packaging device comprising:

means for providing a bag whose mouth includes opening/closing means for multiple successive openings and closings on the one hand, and on the other hand, a cleavable linking veil located at a certain distance therefrom, inside the bag, in relation to said opening/closing means, means for introducing contents to be wrapped into the bag, and means capable of tightening the bag in order to close it, tension being applied to said contents, said veil entering into contact with the contents avoiding the application of stresses on the opening/closing means, guaranteeing free access to the contents via said opening/closing means after tearing, enabling the bag to be relaxed in a closed state as a result of the distance separating the veil and the opening/closing means.

Finally the present invention relates to the bags whose mouth includes opening/closing means for multiple successive openings and closings on the one hand, and on the other hand, a cleavable linking veil located at a certain distance therefrom, inside the bag, in relation to said opening/closing means, such that, when the bag is tightened to close it, tension being applied to the contents, said veil enters into contact with the contents avoiding the application of stresses on the opening/closing means, but guarantees free access to the contents via said opening/closing means after tearing, and enables the bag to be relaxed in a closed state as a result of the distance separating the veil and the opening/closing means.

DRAWINGS

Figure 2:
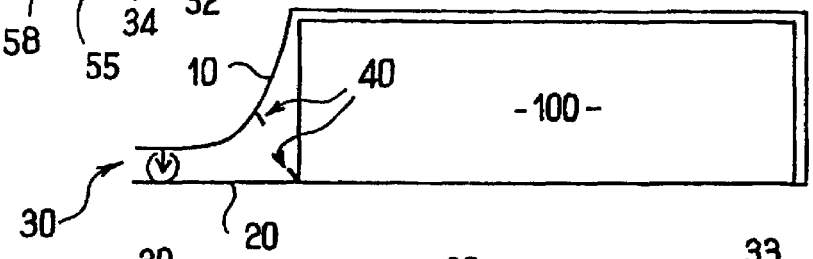
Figure 3:
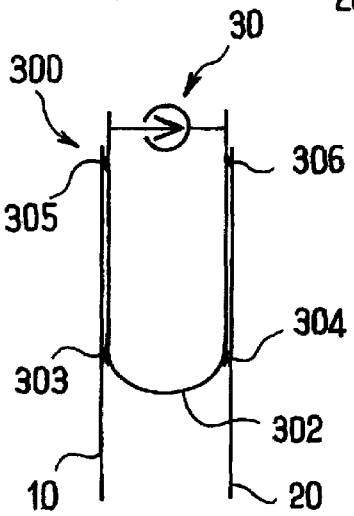
Figure 4:
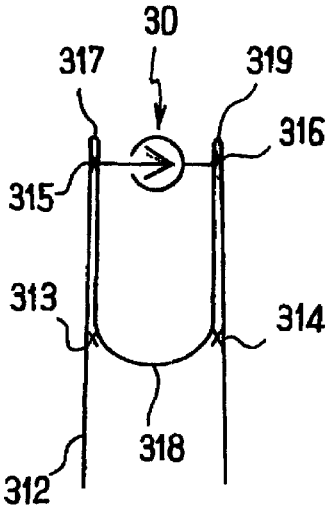
Figure 5:
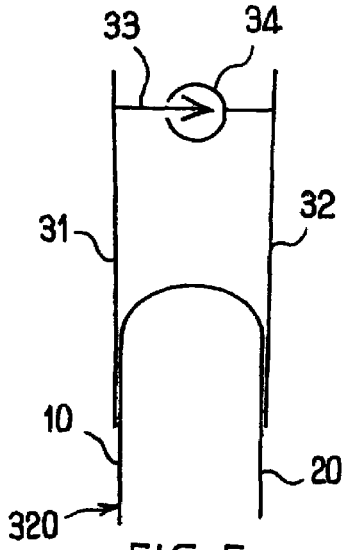
Figure 6:
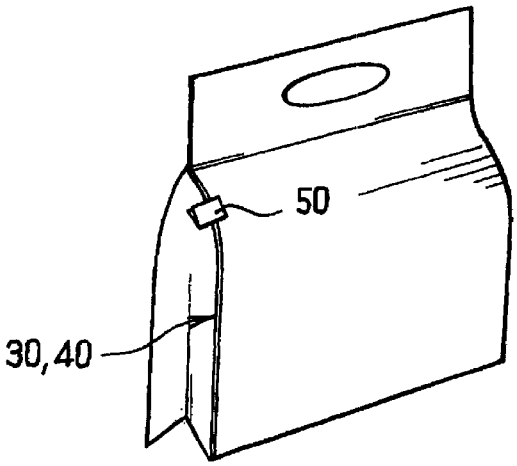

Other features, objects and advantages of the present invention will become apparent upon reading the detailed description which will follow, and with reference to the appended drawings, given as non-limiting examples and wherein:

FIG. 1 schematically illustrates the basic principle of a tightened bag according to the present invention in a storage position, tension being applied to its contents, FIG. 2 schematically illustrates the same bag after a first opening, FIG. 3 illustrates a sectional view of the mouth of a bag according to a first embodiment of the present invention, FIG. 4 illustrates a sectional view of the mouth of a bag according to a second embodiment of the present invention, FIG. 5 illustrates a sectional view of the mouth of a bag according to a third embodiment of the present invention, and FIG. 6 schematically illustrates an example of application of the present invention.

DETAILED DESCRIPTION

A tightened bag according to the present invention has schematically been illustrated in FIGS. 1 and 2, in the storage position, tension being applied to its contents and after a first opening, respectively.

As is seen in the figures, the bag according to the present invention essentially comprises two main walls 10, 20, an opening/closing means 30 and a veil 40 which connects the walls 10, 20 to each other on the inside of the opening/closing means 30 and at a distance therefrom.

The walls 10, 20 may be the subject of many embodiments. Preferably, these are walls in thermoplastic material.

These walls 10, 20 may be monolayered or multilayered and monomaterial or multimaterial walls. If need be, this may be a paper backing coated with a thermoplastic material layer, or even with a metallized thermoplastic material layer.

The opening/closing means 30 and the veil 40 extend parallel to each other through the mouth of the bag.

As for the rest, the mode for linking the walls 10, 20 may be the subject of many embodiments. As a non-limiting example, the walls 10, 20 may be connected to each other, for example by welding or sticking on both of their sides perpendicular to the mouth and to the means 30 and veil 40, the ends of the walls 10, 20 opposite to the mouth being initially separated then brought together, superimposed and connected to each other, by any suitable means, for example by welding or sticking, once the contents positioned in the bag.

The opening/closing means 30 may also be the subject of many embodiments.

They may be formed with male 33 and female 34 complementary profiles respectively positioned on the walls 10, 20 or on respective supporting veils 31, 32, linked to the latter. These may be complementary means in the form of hooks. They may even be opening/closing means of the velvet-hook type. All these means are well known to one skilled in the art. Therefore they will not be described in detail in the following.

If need be, these opening/closing means 30 may be controlled by a cursor 50.

Such a cursor is schematized in the appended FIG. 1. There again, it may be the subject of many embodiments.

Such a cursor 50 preferably comprises a shoe 52 which bears two side webs 54, 55 and a central low wall 56 defining between them two non-parallel channels 57, 58 respectively receiving at least the top of one of the two supporting veils 31, 32 of the opening/closing means 30, so that, according to the displacement direction of the cursor 50, the latter strains the means 30 upon opening and closing, respectively. If need be, but this arrangement is not mandatory, the central low wall 56 may penetrate between the complementary profiles.

As it is seen in FIG. 1, when, after having introduced contents 100 in the thereby formed bag, the latter is tightened and closed onto the contents 100, the veil 40 comes into contact with the contents 100 and bans the application of stresses, due to the internal pressure of the bag, onto the opening/closing means 30. Thus, with the present invention, it is possible to avoid any untimely and unintentional opening of the bag, notably during its handling before use.

On the other hand, as is seen if FIG. 2, once the veil 40 is broken after a first opening, the internal section of the bag is increased by twice the value of the distance D separating the opening/closing means 30 and the veil 40. The bag is thereby relaxed and the user may easily access its contents 100 in spite of the initial compression state of the latter.

As a non-limiting example, the distance D separating the opening/closing means 30 and the veil 40, is typically of the order of 2 to 5 cm.

Several preferential and non-limiting embodiments of the mouth of the bag according to the present invention will now be described with reference to the appended FIGS. 3 to 5.

As is seen on the whole of these figures, preferably within the scope of the present invention, the conformation of the mouth of the bag comprises at least a welding step.

According to FIG. 3, a closing assembly 300 formed with a sheet 302, folded as a U on itself and including opening/closing means 30 at its opening contour is welded with the concavity turned outwards on the mouth of the bag between the walls 10 and 20. The middle portion of the sheet 302, i.e., the fold of the latter, plays the role of the veil 40. The sheet 302 may be attached, for example by sticking or welding, onto the walls 10 and 20, over the entirety of the height of its surface in contact with the latter. However, alternatively, the sheet 302 may be attached on the walls 10 and 20 only near its middle area, at the areas referenced as 303 and 304 in FIG. 3. Preferably, the sheet 302 is also attached onto the walls 10 and 20 near its free edges at the referenced areas 305 and 306 in FIG. 3.

A second embodiment according to the invention of the mouth of a bag is illustrated in FIG. 4, which consists of folding a sheet 312 on itself as a W in the form of a central fold 318 and two side folds 317 and 319, and of welding at 313 and 314 the top of the central fold 318 thereby formed on the adjacent surfaces of the side components of the sheet. If need be, the side folds 317 and 319 at 315 and 316 near the top of the mouth may also be welded. The opening/closing means 30 are provided inside the central fold 318 between both side folds 317 and 319. The means 30 may be issued from material, notably from an extrusion, on the sheet 312 or added and attached by any suitable means, notably by welding or sticking on the latter.

A third embodiment of the mouth of a bag according to the present invention is illustrated in FIG. 5, which consists of folding a sheet 320 as a U on itself, which forms the main walls 10 and 20 of the bag, and attaching on the outside of this fold, a closing assembly comprising two supporting veils 31, 32 which bear respective means 33, 34. Once again, the supporting veils 31, 32 may be attached onto the sheet 320 by any suitable means for example by welding or sticking.

Of course, the present invention is not limited to the particular embodiments which have just been described but is extended to all the alternatives which comply with its spirit.

As schematized in FIG. 6, the mouth comprising the means 30 and the veil 40 may for example be integrated into the fold of bellows for a packaging bag.

The present invention may notably find application in the making of packaging bags for baby diapers or any equivalent protective means.

In this context, with it, in particular, it is possible to reduce the storage volume by guaranteeing high compression of the contents, while banning any untimely opening before use.

The invention claimed is:

1. A packaging method comprising:

providing a bag comprising two main walls, having a mouth including an opening/closing means (30) for multiple successive openings and closings, a cleavable linking veil (40), located at a distance (D) from the opening/closing means (30), inside the bag in relation to said opening/closing means (30), introducing contents (100) to be wrapped in the bag, tightening of the bag to close it and applying tension to said contents (100), said veil (40) entering into contact with the contents (100) to avoid the application of stress on the opening/closing means (30), providing free access to the contents (100) via said opening/closing means (30) after tearing of said cleavable linking veil, enabling the bag to relax in a closed state as a result of the distance separating the veil (40) and the opening/closing means (30), wherein said cleavable linking veil (40) is a U sheet, and fixing the U sheet to the bag by welding the U sheet to each of the two main walls of the bag at the distance from said opening/closing means (30).

2. The method of claim 1, wherein the step for providing the bag comprises a welding step at the mouth of the bag.

3. The method of claim 1, wherein the providing step comprises providing a closing assembly (300) including the U sheet that is formed by folding a sheet (302) into a U shape, the assembly (300) including opening/closing means (30), and welding the assembly (300) with a concave surface of the U sheet turned toward the mouth of the bag between the main walls (10, 20).

4. The method of claim 3, wherein the U sheet (302) is attached on the main walls (10, 20) at least near a middle area of the sheet.

5. The method of claim 4, wherein the U sheet (302) is also attached onto the main walls (10, 20) near free edges of the sheet.

6. The method of claim 1, wherein the providing step includes folding a sheet (312) into a W shape including a central fold (318) and two side folds (317, 319), and of welding (313, 314) the top of the central fold (318) between the main walls (10, 20) of the bag at a distance of said opening/closing means (30).

7. The method of claim 6, further comprising the step of welding the side folds (317, 319) near the mouth of the bag.

8. The method of claim 1, wherein the opening/closing means (30) comprise a cursor (50).

9. The method of claim 1, wherein the filling of the bag is performed through the end of the latter opposite to its mouth.

10. The method of claim 1, wherein the distance (D) separating the opening/closing means (30) and the veil (40) is between 2 and 5 cm.

11. A packaging method comprising:

providing a bag, said bag having two main walls, whose mouth includes opening/closing means (30) for multiple successive openings and closings, a cleavable linking veil (40), located at a distance from said opening/closing means (30), inside the bag in relation to said opening/closing means (30);

introducing contents (100) to be wrapped in the bag; and tightening of this bag to close it and applying tension to said contents (100), said veil (40) entering into contact with the contents (100) to avoid the application of stresses on the opening/closing means (30), providing free access to the contents (100) via said opening/closing means (30) after tearing of said cleavable linking veil, and enabling the bag to be relaxed in a closed state as a result of the distance (D) separating the veil (40) and the opening/closing means (30), wherein the providing step comprises folding a sheet (320) into a U shape, to form the main walls (10, 20) of the bag;

attaching, onto the fold, a closing assembly comprising two supporting veils (31, 32) which bear respective opening/closing means (33, 34); and welding said two supporting veils on each of the two main walls of the bag on each side of the U fold, at the distance (D) from said opening/closing means (30).

12. The method of claim 11, wherein the opening/closing means (3) comprise a cursor (50).

13. The method of claim 11, wherein the filling of the bag is performed at an end of the bag opposite to its mouth.

14. The method of claim 11, wherein the distance (D) separating the opening/closing means (3) and the veil (40) is between 2 and 5 cm.

* * * * *